US008555751B1

(12) United States Patent
Chern

(10) Patent No.: US 8,555,751 B1
(45) Date of Patent: Oct. 15, 2013

(54) ADJUSTABLE RATCHET WRENCH

(76) Inventor: Shwu-Ruu Chern, Taichung (TW)

( * ) Notice: Subject to any disclaimer, the term of this patent is extended or adjusted under 35 U.S.C. 154(b) by 0 days.

(21) Appl. No.: 13/587,777

(22) Filed: Aug. 16, 2012

(51) Int. Cl.

| | |
|---|---|
| ***B25B 13/46*** | (2006.01) |
| ***B25B 23/16*** | (2006.01) |
| ***B25B 17/00*** | (2006.01) |
| ***B25B 21/00*** | (2006.01) |
| ***B25B 13/06*** | (2006.01) |
| ***B25G 1/00*** | (2006.01) |

(52) U.S. Cl.
USPC ..... 81/63; 81/57.13; 81/57.3; 81/121.1; 81/177.85; 81/60; 81/61; 81/62; 81/63.2

(58) Field of Classification Search
USPC ..... 81/57.13, 57.3, 121.1, 177.85, 60–63.2
See application file for complete search history.

(56) References Cited

U.S. PATENT DOCUMENTS 6,164,167 A * 12/2000 Chen ..... 81/63.2
6,282,992 B1 * 9/2001 Hu ..... 81/63.2
6,516,690 B2 * 2/2003 Chen ..... 81/63
2005/0155465 A1 * 7/2005 Lee et al. ..... 81/63.2
2007/0256524 A1 * 11/2007 Cornwell et al. ..... 81/57.3
2007/0277652 A1 * 12/2007 Tuan-Mu ..... 81/63
2009/0301266 A1 * 12/2009 Hu ..... 81/62
2010/0132517 A1 * 6/2010 Crawford ..... 81/63

* cited by examiner

*Primary Examiner* — Monica Carter
*Assistant Examiner* — Danny Hong
(74) *Attorney, Agent, or Firm* — Pro-Techtor Int'l Services

(57) ABSTRACT

A ratchet wrench includes a handle and a pawl is pivotably connected to the handle. The pawl is selectively engaged with a positioning unit in the handle. A ratchet wheel has a through hole defined through the center portion thereof and the ratchet teeth of the ratchet wheel are engaged with the engaging teeth of the pawl. Two clamp members are inserted in the through hole of the ratchet wheel and each have an extension. Each extension has a slot defined in top and bottom thereof. The two extensions extend toward opposite directions. Two ring-shaped covers are respectively connected to the top and the bottom of the ratchet wheel and each cover has two openings defined in the underside thereof. The extensions extend through the openings. Pins extend through the covers and are engaged with the slots. The clamp members are movable to clamp objects of different sizes.

6 Claims, 9 Drawing Sheets

ADJUSTABLE RATCHET WRENCH

The present invention relates to a ratchet wrench, and more particularly, to an adjustable ratchet wrench so as to mount objects of different sizes without replacing sockets or the like.

BACKGROUND OF THE INVENTION

The conventional wrenches such as open-end wrenches are used to tighten or loosen the objects with a hexagonal head. However, different sizes of the hexagonal heads require the wrenches with different opening sizes, this is inconvenient for the users.

Some users use a monkey wrench to tighten or loosen the objects with the hexagonal head, however, the monkey wrench is heavy and can be only operated in one direction.

Ratchet wrenches are developed for easily tighten or loosen the objects by repeatedly swing the ratchet wrench to achieve the same purposes. The conventional ratchet wrench has a ratchet wheel located in the function end of the wrench and a pawl is pivotably connected to the head of the wrench. The pawl controls the direction that the wrench outputs torque.

Nevertheless, a socket is needed to be connected with the wrench and then the socket is mounted to the hexagonal head of the object. However, different sizes of the hexagonal heads need different sizes of the sockets. In other words, the users still have to prepare multiple sockets and use the correct one to tighten or loosen the objects.

The present invention intends to provide a ratchet wrench wherein the size for the objects can be adjusted without replacing any part.

SUMMARY OF THE INVENTION

The present invention relates to a ratchet wrench and comprises a handle having an end hole defined in one end thereof and a positioning unit is accommodated in the end hole. Two plates clamp the handle therebetween and each plate has a mounting hole and a connection hole. A pawl has two recesses defined in the rear end thereof and engaging teeth are defined in two sides of the front end of the pawl. A pivotal hole is defined through the pawl and a pin extends through the pivotal hole of the pawl, the two respectively connection holes and the handle. The positioning unit of the handle is engaged with one of the two recesses. A ratchet wheel has ratchet teeth defined in the outer periphery thereof and a through hole is defined through the center portion of the ratchet wheel. Two contact portions extend from the inner periphery of the through hole. The ratchet wheel is located in the mounting holes of the two plates and the ratchet teeth are engaged with the engaging teeth of the pawl. Two clamp members each have an extension extending therefrom. Each extension has a slot defined in top and bottom thereof. The two clamp members are inserted in the through hole of the ratchet wheel. The two extensions extend toward opposite directions. Two ring-shaped covers each have two openings defined in the underside thereof and two holes are defined in the top of each of the two covers. The two holes are respectively located corresponding to the openings. The two covers are respectively connected to the top and the bottom of the ratchet wheel. The extensions extend through the openings. Multiple pins extend through the holes and respective lower ends of the pins are engaged with the slots.

Preferably, the positioning unit comprises a spring and a bead.

Preferably, the two covers each have an anti-slip surface defined in the outer periphery thereof.

Preferably, the two clamp members each are a V-shaped member.

Preferably, each of the clamp members has a notch in which a magnetic member is located.

Preferably, the magnetic member is a magnet.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
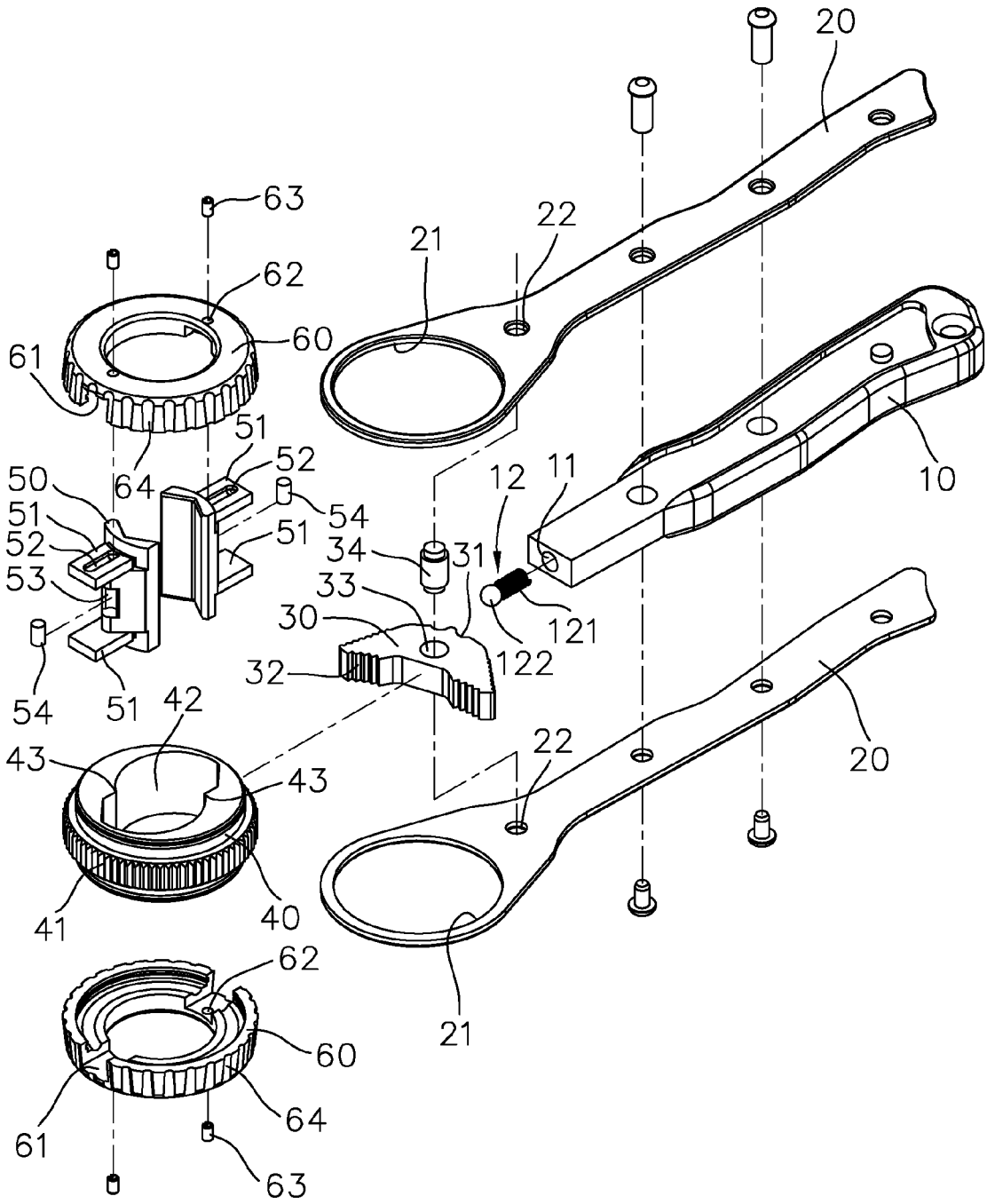
FIG. 1 is an exploded view to show the ratchet wrench of the present invention.
Figure 2:
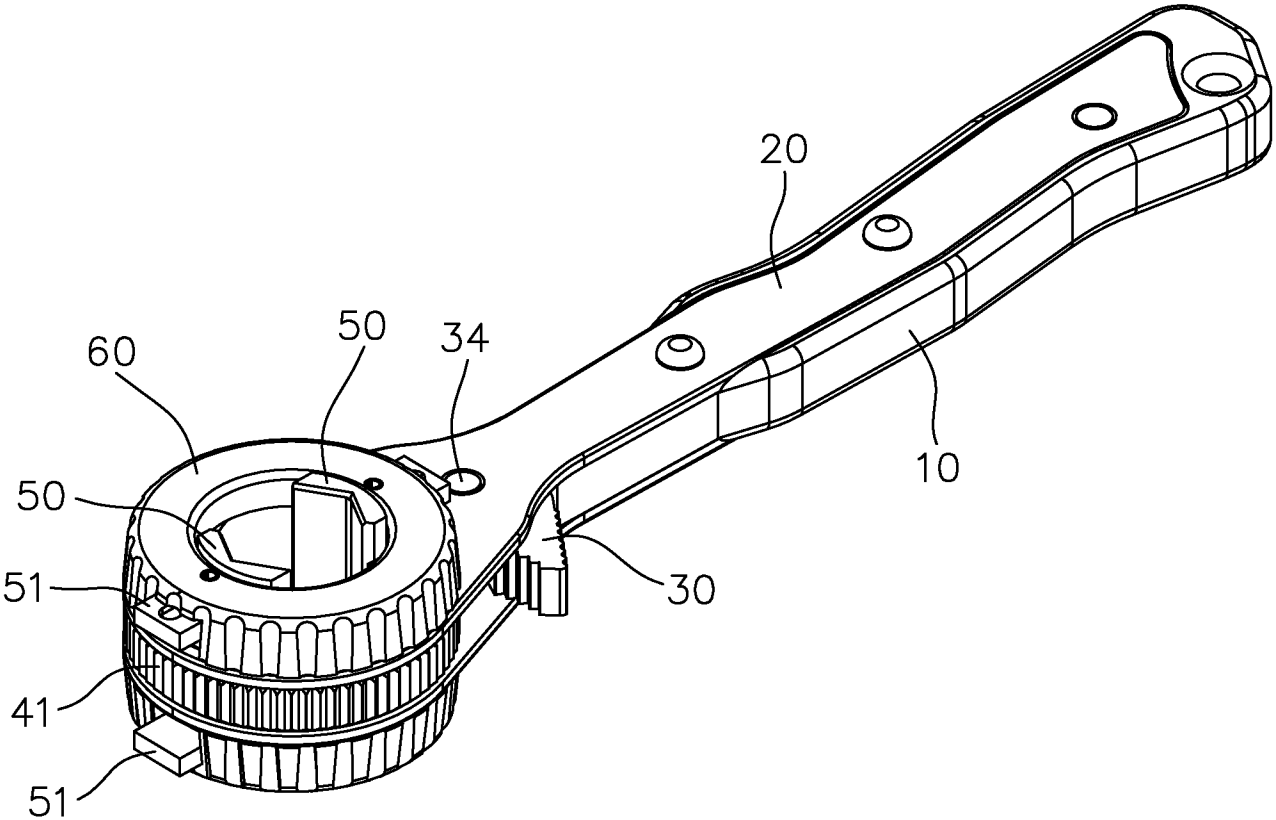
FIG. 2 is a perspective view to show the ratchet wrench of the present invention.
Figure 3:
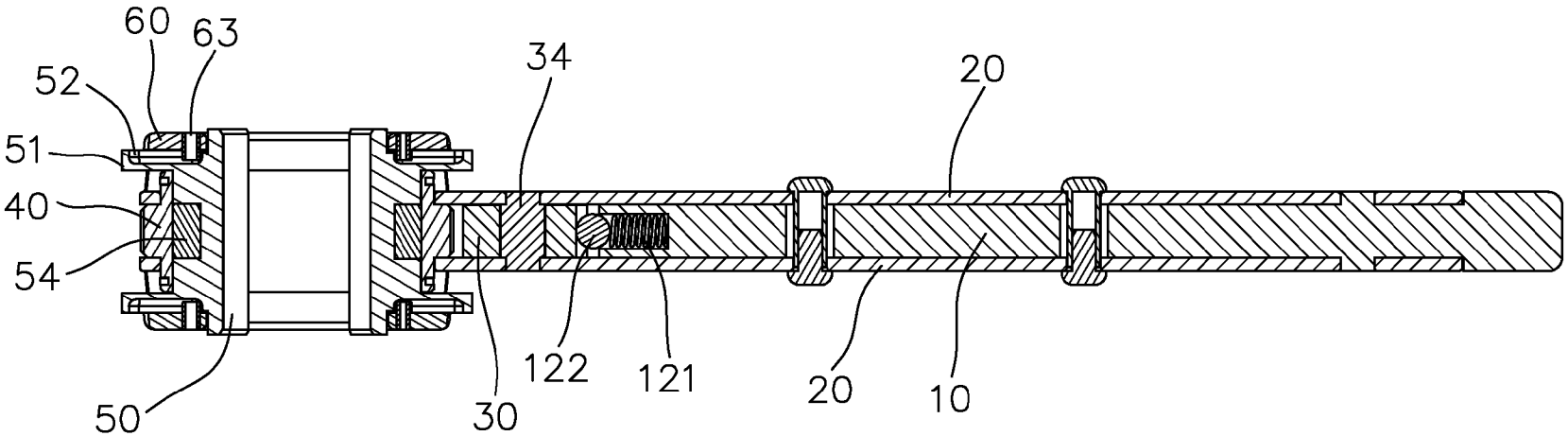
FIG. 3 is a cross sectional view of the ratchet wrench of the present invention.
Figure 4:
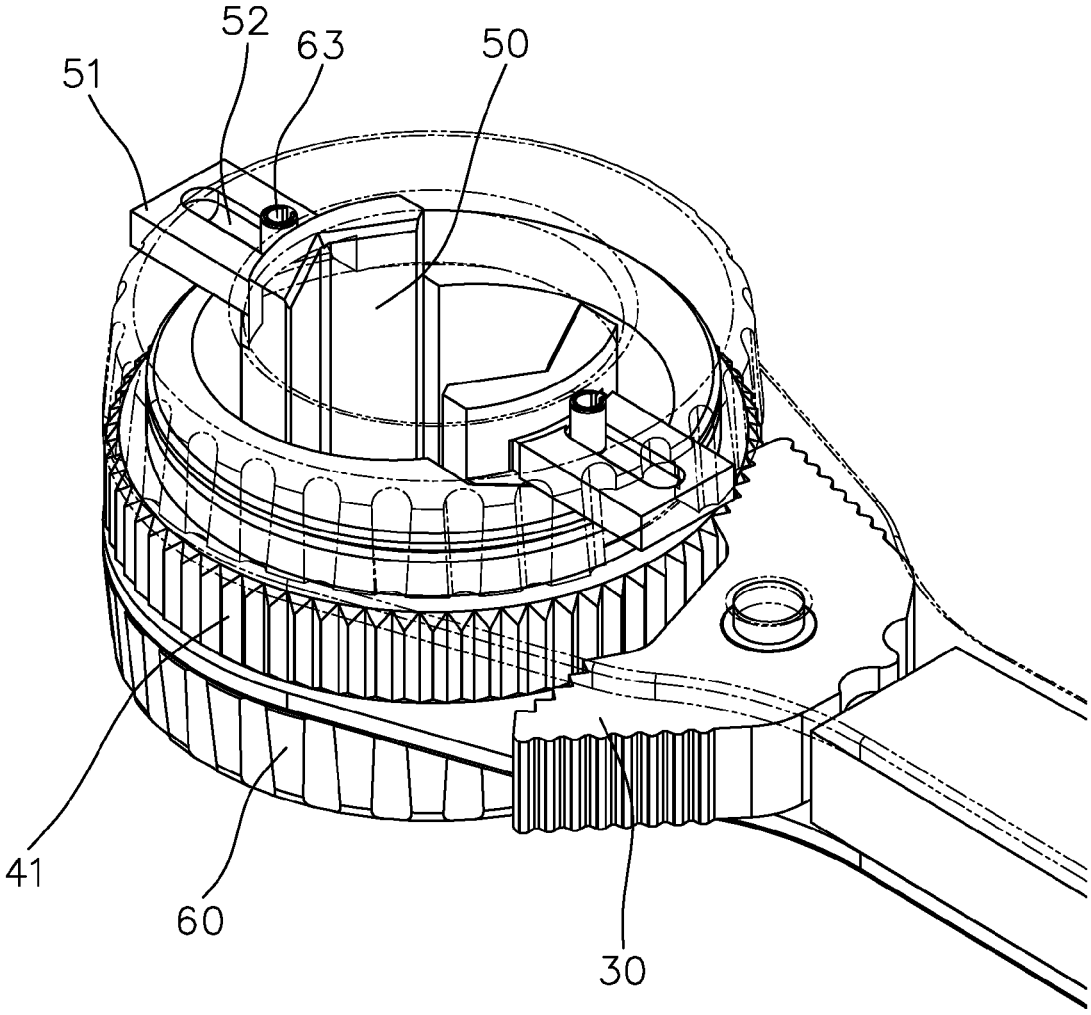
FIG. 4 is an enlarged perspective view of the ratchet wrench of the present invention.
Figure 5:
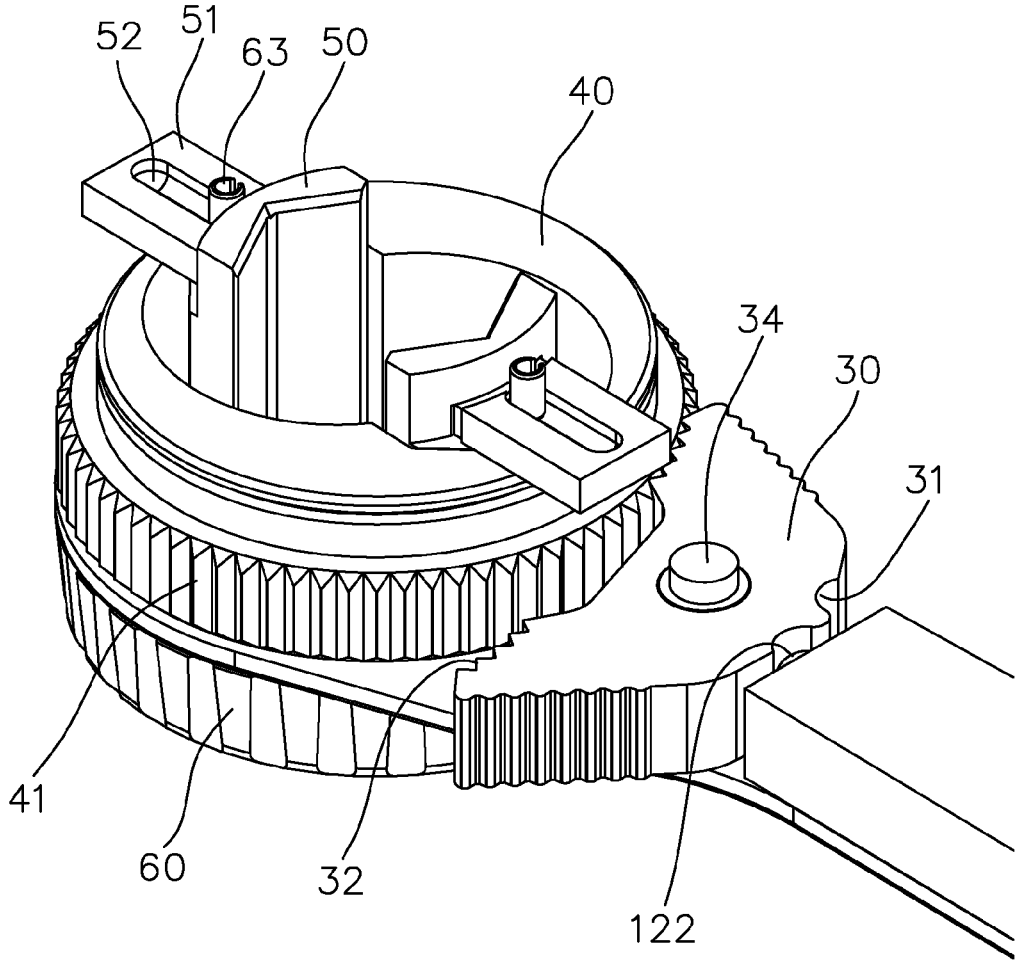
FIG. 5 is another enlarged perspective view of the ratchet wrench of the present invention.

Referring to FIGS. 1 to 9, the ratchet wrench of the present invention comprises a handle 10 having an end hole defined, in one end thereof and a positioning unit 12 is accommodated in the end hole 11. The positioning unit 12 comprises a spring 121 and a bead 122.

Two plates 20 clamp handle 10 therebetween and each plate 20 has a mounting hole 21 defined in an end thereof. Multiple holes are defined through each of the two plates 20 such that rivets fix the two plates 20 to the handle 10 via the holes 22. Each plate 20 further has a connection hole 22 located close to the mounting hole 21.

A pawl 30 has two recesses 31 defined in the rear end thereof and engaging teeth 32 are defined in two sides of the front end of the pawl 30. A pivotal hole 33 is defined through the pawl 30 and a pin 34 extends through the pivotal hole 33 of the pawl 30, the two respectively connection holes 22 and the handle 10. The positioning unit 12 of the handle 10 is engaged with one of the two recesses 31.

A ratchet wheel 40 has ratchet teeth 41 defined in the outer periphery thereof and a through hole 42 is defined through the center portion of the ratchet wheel 40. Two contact portions 43 extend from the inner periphery of the through hole 42. The ratchet wheel 40 is located in the mounting holes 21 of the two plates 20 and the ratchet teeth 41 are engaged with the engaging teeth 32 of one of the two sides of the pawl 30.

Figure 10:
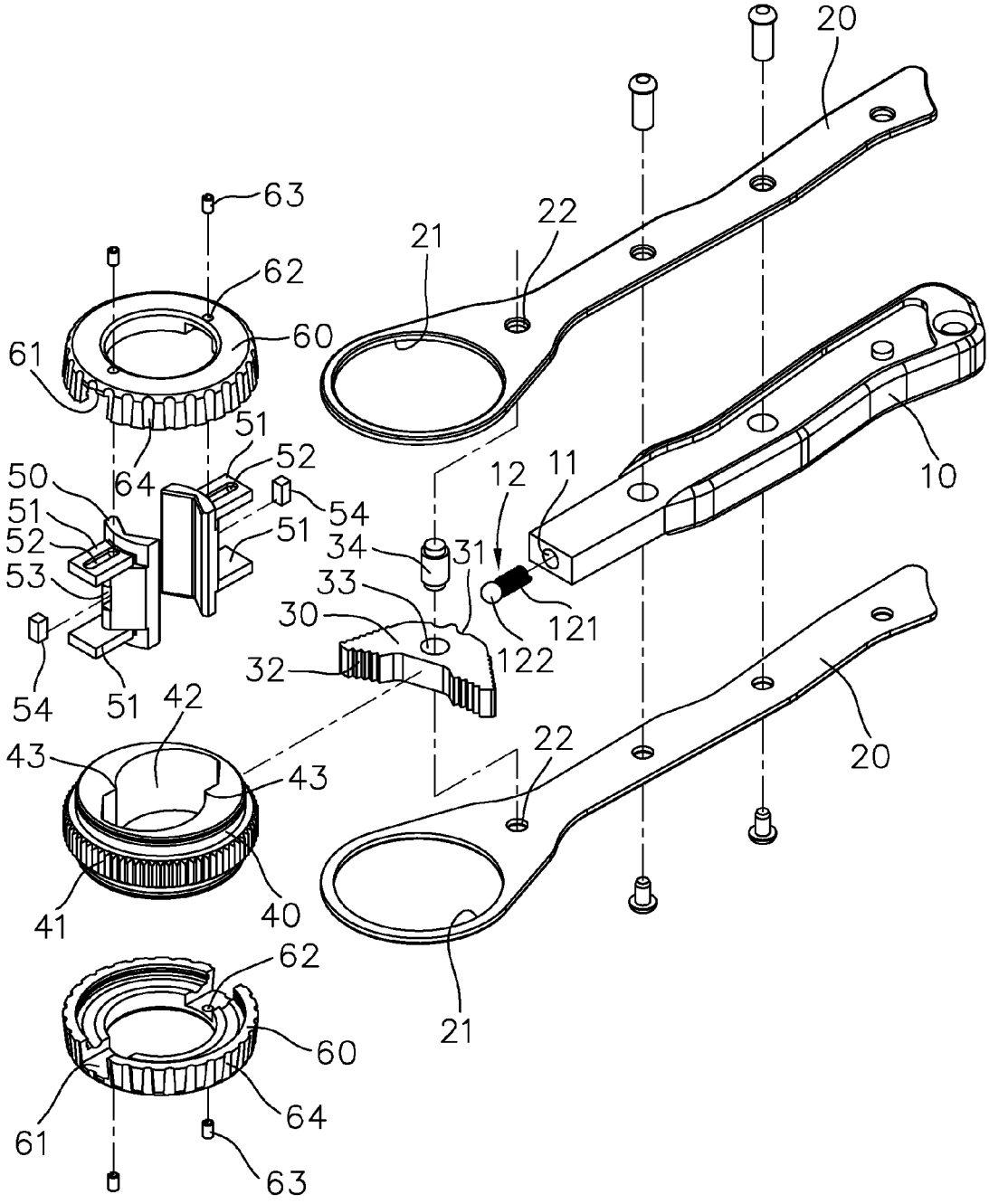
FIG. 10 is an exploded, view to show another embodiment of the ratchet wrench of the present invention.
Figure 11:
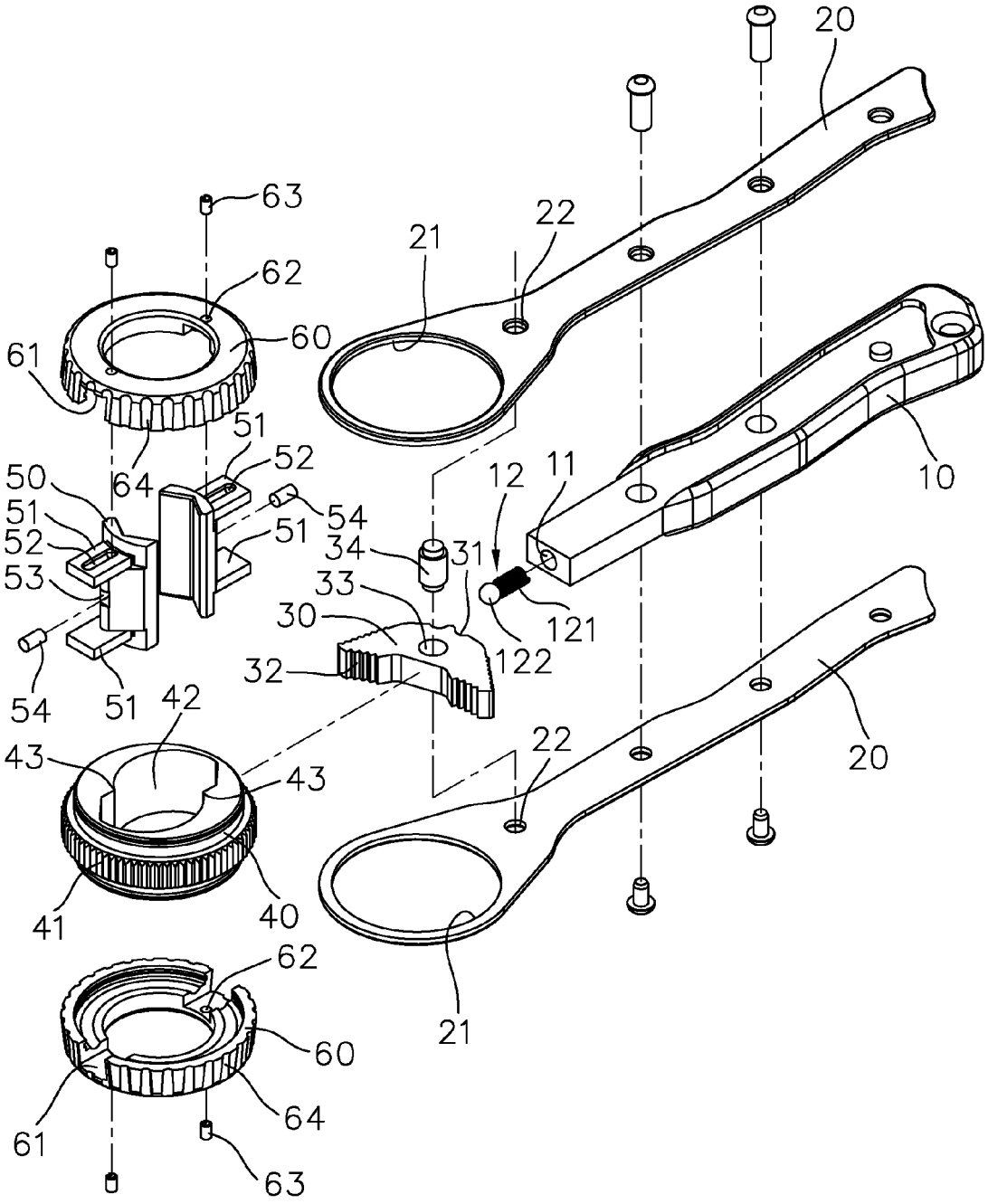
FIG. 11 is an exploded view to show yet another embodiment of the ratchet wrench of the present invention.

Two V-shaped clamp members 50 each have two extensions 51 extending therefrom. The two extensions 51 of each clamp member 50 each have a slot 52 which faces the hole 62 of the cover 60 corresponding thereto which will be described later. The two clamp members 50 are inserted in the through hole 42 of the ratchet wheel 40 and the two extensions 51 of one clamp member 50 extend toward the opposite direction from that of the other clamp member 50. Each of the clamp members 50 has a notch 53 in which a magnetic member 54 is located. In this embodiment, the magnetic member 54 is a magnet. The magnetic member 54 is installed upright as shown in FIG. 1. The magnetic member 54 is installed transversely as shown in FIG. 11. The magnetic member 54 can be a cylindrical magnet as shown in FIG. 1 or a rectangular magnet as shown in FIG. 10.

Two ring-shaped covers 60 each have two openings 61 defined in the underside thereof. Two holes 62 are defined in the top of each of the two covers 60 and respectively located corresponding to the openings 61. The two covers 60 are respectively connected to the top and the bottom of the ratchet wheel 40. The extensions 51 extend through the openings 61. Multiple pins 63 extend through the holes 62 of the two covers 60 and the respective lower ends of the pins 63 are engaged with the slots 52. The two covers 60 each have an anti-slip surface 64 defined in the outer periphery thereof.

Figure 6:
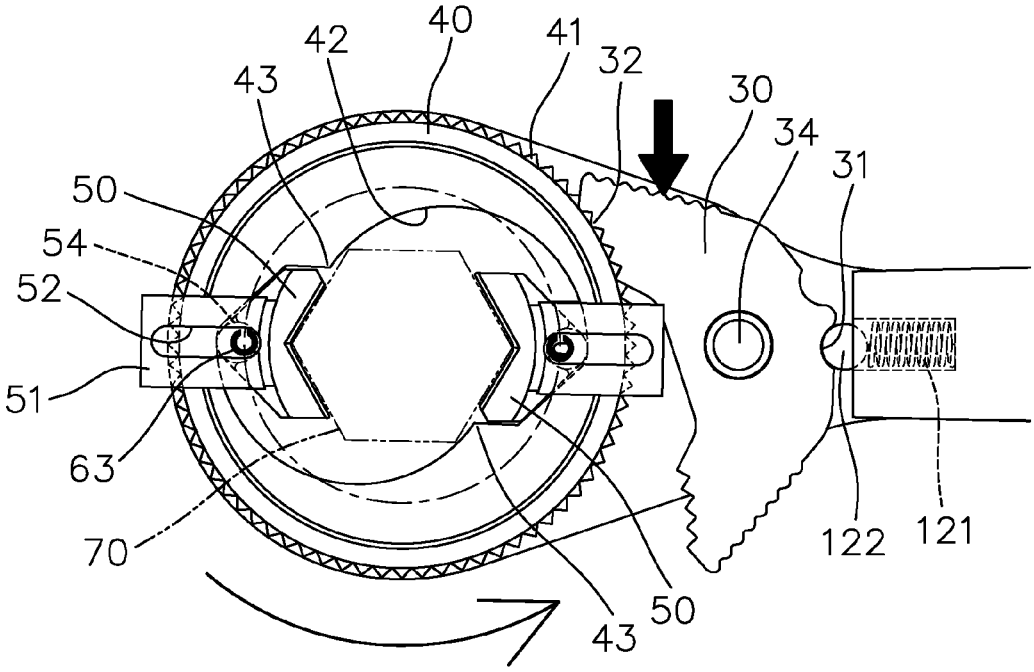
FIG. 6 is shows that the positioning unit is engaged with one of the recesses of the pawl of the ratchet wrench of the present invention.
Figure 7:
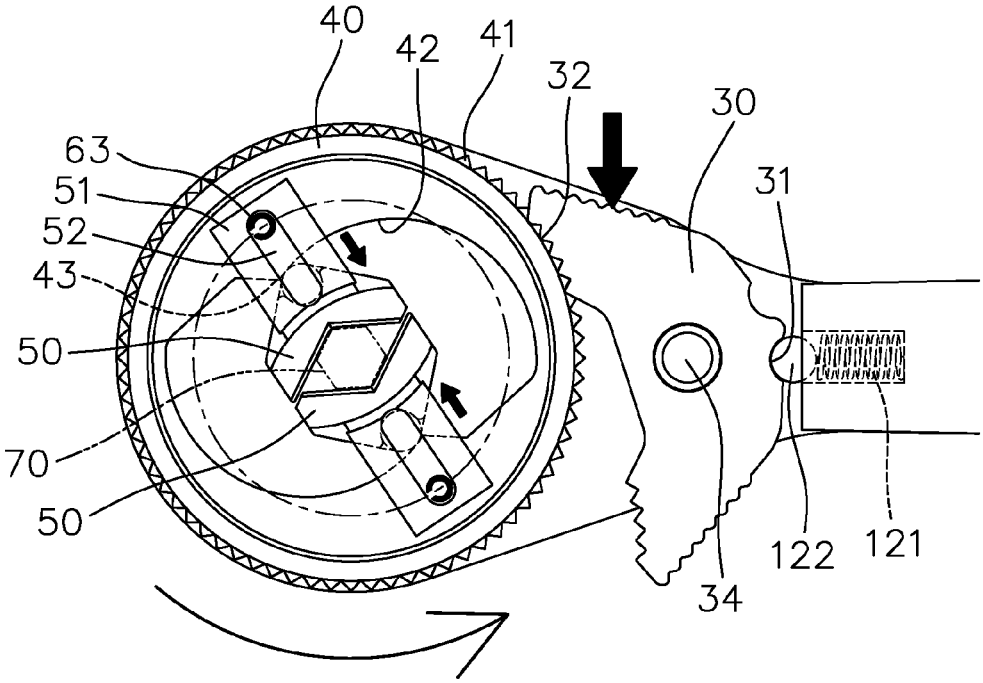
FIG. 7 shows that the covers are rotated under the status in FIG. 6 to move the two clamp members toward each other.
Figure 8:
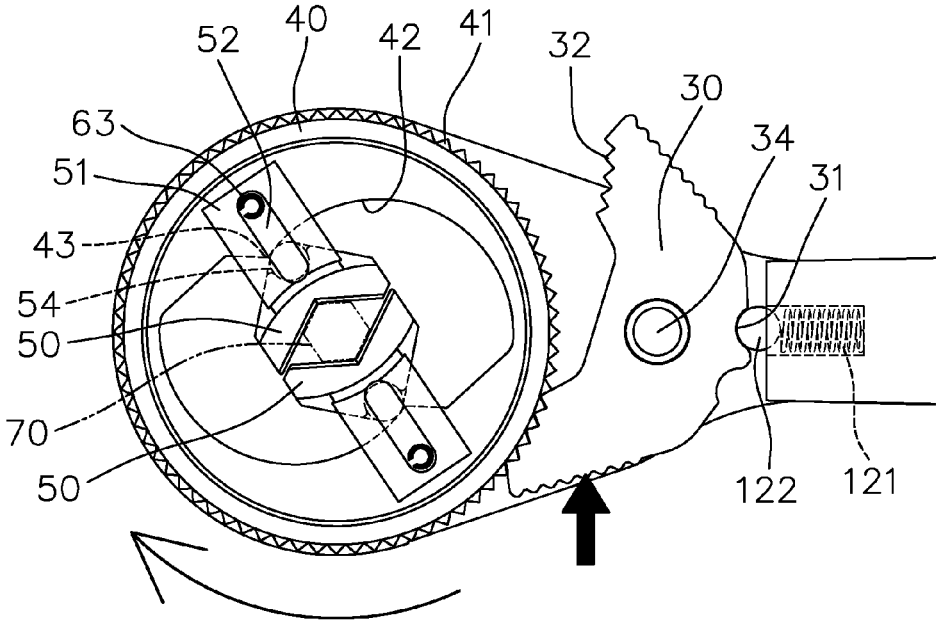
FIG. 8 is shows that the positioning unit is engaged with the other one of the recesses of the pawl of the ratchet wrench of the present invention.
Figure 9:
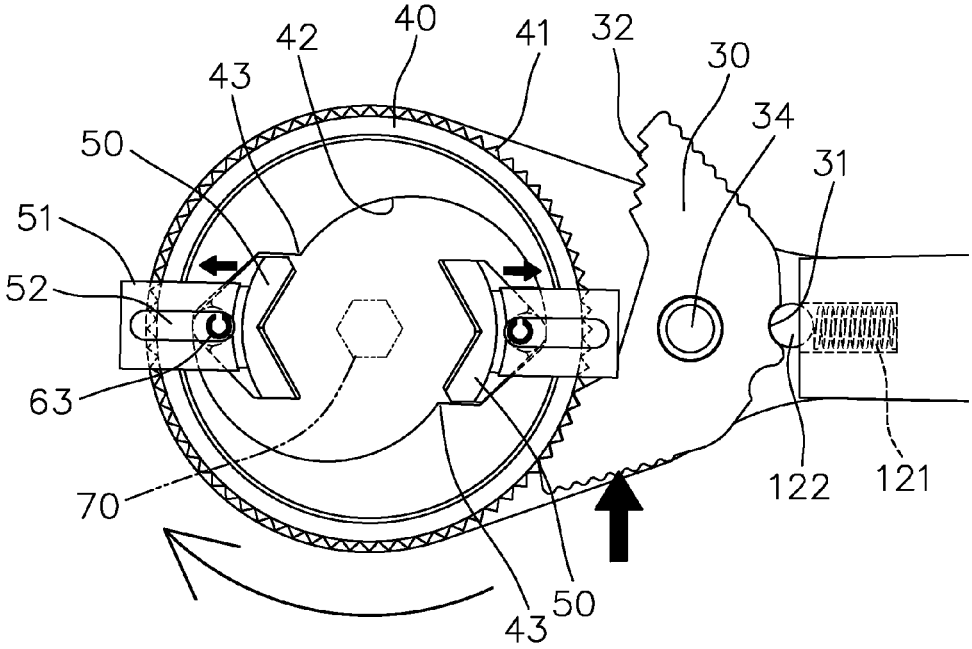
FIG. 9 shows that the covers are rotated under the status in FIG. 8 to move the two clamp members toward each other.

When using the ratchet wrench to clamp a square or hexagonal object 70, the object 70 is located between the two clamp members 50 and the covers 60 are rotated. The clamp members 50 are moved along the non-circular inner periphery of the through hole 42 of the ratchet wheel 40, the clamp members 50 are pushed by the contact portions 43 so as to move toward each other and clamp the object 70 as shown in FIGS. 6 and 7. By selectively engaging the engaging teeth 32 with the ratchet teeth 41 of the ratchet wheel 40, the ratchet wrench can be rotated clockwise or counter clockwise to tighten or loosen the object 70.

The present invention does not need any socket to be connected with the object 70 and the size for clamping the object 70 can be adjusted by rotating, the covers 60.

While we have shown and described the embodiment in accordance with the present invention, it should be clear to those skilled in the art that further embodiments may be made without departing from the scope of the present invention.

What is claimed is:

1. A ratchet wrench comprising:

a handle having an end hole defined in an end thereof and a positioning unit being accommodated in the end hole;

two plates clamping the handle therebetween and each plate having a mounting hole defined in an end thereof, a connection hole defined through each of the two plates;

a pawl having two recesses defined in a rear end thereof, engaging teeth defined in two sides of a front end of the pawl, a pivotal hole defined through the pawl and a pin extending through the pivotal hole of the pawl, the two respectively connection holes and the handle, the positioning unit of the handle engaged with one of the two recesses;

a ratchet wheel having ratchet teeth defined in an outer periphery thereof and a through hole defined through a center portion of the ratchet wheel, two contact portions extending from an inner periphery of the through hole, the ratchet wheel located in the mounting holes of the two plates and the ratchet teeth engaged with the engaging teeth of the pawl;

two clamp members each having an extension extending therefrom, each extension having a slot defined in top and bottom thereof, the two clamp members inserted in the through hole of the ratchet wheel, the two extensions extending toward opposite directions, and two ring-shaped covers each having two openings defined in an underside thereof, two holes defined in a top of each of the two covers and respectively located corresponding to the openings, the two covers respectively connected to a top and a bottom of the ratchet wheel, the extensions extending through the openings, multiple pins extending through the holes and respective lower ends of the pins engaged with the slots.

2. The ratchet wrench as claimed in claim 1, wherein the positioning unit comprises a spring and a bead.

3. The ratchet wrench as claimed in claim 1, wherein the two covers each have an anti-slip surface defined in an outer periphery thereof.

4. The ratchet wrench as claimed in claim 1, wherein the two clamp members each are a V-shaped member.

5. The ratchet wrench as claimed in claim 1 wherein each of the clamp members has a notch in which a magnetic member is located.

6. The ratchet wrench as claimed in claim 5, wherein the magnetic member is a magnet.

* * * * *